US010166557B2

(12) United States Patent
Seitz

(10) Patent No.: US 10,166,557 B2
(45) Date of Patent: Jan. 1, 2019

(54) ELECTROSTATIC SPRAY TOOL SYSTEM

(71) Applicant: Carlisle Fluid Technologies, Inc., Charlotte, NC (US)

(72) Inventor: David Martin Seitz, Riga, MI (US)

(73) Assignee: Carlisle Fluid Technologies, Inc., Charlotte, NC (US)

( * ) Notice: Subject to any disclaimer, the term of this patent is extended or adjusted under 35 U.S.C. 154(b) by 0 days.

(21) Appl. No.: 15/059,170

(22) Filed: Mar. 2, 2016

(65) Prior Publication Data

US 2016/0256878 A1 Sep. 8, 2016

Related U.S. Application Data

(60) Provisional application No. 62/127,494, filed on Mar. 3, 2015.

(51) Int. Cl.

| | |
|---|---|
| ***B05B 5/03*** | (2006.01) |
| ***B05B 5/053*** | (2006.01) |
| ***B05B 7/06*** | (2006.01) |
| ***B05B 7/08*** | (2006.01) |
| ***B05B 7/12*** | (2006.01) |

(52) U.S. Cl.

CPC ..... *B05B 5/03* (2013.01); *B05B 5/0532* (2013.01); *B05B 5/0533* (2013.01); *B05B 7/066* (2013.01); *B05B 7/0815* (2013.01); *B05B 7/1209* (2013.01); *B05B 5/0535* (2013.01)

(58) Field of Classification Search

CPC ..... B05B 5/03; B05B 5/032; B05B 5/0532; B05B 5/0533; B05B 5/0535; B05B 7/066; B05B 7/0815; B05B 7/1209

USPC ..... 239/690–708

See application file for complete search history.

(56) References Cited

U.S. PATENT DOCUMENTS

| | | | | |
|---|---|---|---|---|
| 3,677,470 | A * | 7/1972 | Probst | B05B 5/0533 239/707 |
| 4,004,733 | A | 1/1977 | Law | |
| 4,186,886 | A * | 2/1980 | Sickles | B05B 5/043 239/600 |
| 4,702,420 | A | 10/1987 | Rath | |
| 5,704,554 | A | 1/1998 | Cooper et al. | |

(Continued)

FOREIGN PATENT DOCUMENTS

| | | | |
|---|---|---|---|
| EP | 1800756 | | 6/2007 |
| JP | 2007203158 | A | 8/2007 |
| JP | 2008049264 | A * | 3/2008 |

OTHER PUBLICATIONS

PCT International Search Report and Written Opinion; Application No. PCT/US2016/020776; dated May 23, 2016; 13 pages.

(Continued)

*Primary Examiner* — Alexander Valvis
*Assistant Examiner* — Cody Lieuwen
(74) *Attorney, Agent, or Firm* — Fletcher Yoder, P.C.

(57) ABSTRACT

An electrostatic spray system includes an electrostatic tool, a spray tip assembly configured to receive a coating material, and an airflow to atomize and charge the coating material, and spray the coating material in an airflow direction. The spray tip assembly includes a first air cap horn having a recess in a first distal surface, a first charging pin disposed within the recess, and a grounded pin coupled to the spray tip assembly. The first charging pin and the grounded pin are configured to produce an electric field that charges the coating material.

24 Claims, 4 Drawing Sheets

(56) References Cited

U.S. PATENT DOCUMENTS

| | | | | |
|---|---|---|---|---|
| 7,552,882 | B2 * | 6/2009 | Matsumoto | B05B 5/0533 239/691 |
| 7,748,651 | B2 | 7/2010 | Amari et al. | |
| 7,784,718 | B2 * | 8/2010 | Ohno | B05B 5/03 239/291 |
| 2007/0039546 | A1 * | 2/2007 | Amari | B05B 5/03 118/629 |
| 2008/0213499 | A1 * | 9/2008 | Matsumoto | B05B 5/03 427/483 |
| 2012/0207651 | A1 | 8/2012 | Micheli et al. | |

OTHER PUBLICATIONS

Air Electrostatic Hand Gun HB Series HB-X3—HB5000—HB6000, 2014, 067-2E, Asahi Sunac Corporation, Japan.

* cited by examiner

ELECTROSTATIC SPRAY TOOL SYSTEM

CROSS-REFERENCE TO RELATED APPLICATION

This application claims priority to and benefit of U.S. Provisional Patent Application No. 62/127,494, entitled "ELECTROSTATIC SPRAY TOOL SYSTEM," filed on Mar. 3, 2015, which is hereby incorporated by reference in its entirety.

BACKGROUND

The present application relates generally to an electrostatic spray tool.

Electrostatic spray tools output sprays of electrically charged materials to more efficiently coat objects. For example, electrostatic tools may be used to paint objects. In operation, the material is charged when it leaves a spray tip of the electrostatic tool and travels toward the object, which is grounded. The grounded target attracts the electrically charged material, which then adheres to an external surface of the grounded target. Unfortunately, the electrically charged material may not completely transfer from the spray tip to the external surface. For example, some material can stick to the spray tip. The stuck material can block the electric field produced by the electrostatic tool, which causes inconsistent application of the material to the external surface of the grounded target.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment a system includes an electrostatic spray system having an electrostatic tool, and a spray tip assembly configured to receive a coating material and an airflow to atomize and charge the coating material, and spray the coating material in an airflow direction. The spray tip assembly includes a first air cap horn having a recess in a first distal surface, a first charging pin disposed within the recess, and a grounded pin coupled to the spray tip assembly. The first charging pin and the grounded pin are configured to produce an electric field that charges the coating material.

In another embodiment a system includes an air atomization cap configured to couple to a barrel of an electrostatic tool system having a central atomization orifice configured to atomize a liquid material, a distal surface around the central atomization orifice, a first recess disposed on the distal surface, a first pin disposed within the recess, and a center pin disposed within the central atomization orifice. The first pin and the center pin are configured to propagate an electric field.

In another embodiment a system includes an electrostatic spray device having a first outlet configured to output a spray material into a region downstream from the first outlet, a first conductive member disposed in a first recess, and a second conductive member offset from the first conductive member. The first and second conductive members are configured to help generate an electric field in the region downstream from the first outlet.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is generally directed to an electrostatic tool system capable of electrically charging a material sprayed with a compressed gas, such as air. More specifically, the disclosure is directed towards an electrostatic charging system that enables charging pins to remain free of material that would otherwise disrupt charging and generally cause less effective coating of an object. For example, an operator may continuously spray a coating material without changing the air cap. In the embodiments disclosed below, the charging pins are located in a position such that they remain free of the coating material. That is, rather than stray particles of the coating material getting stuck to the charging pins, the air cap includes recesses (e.g., divots, grooves, dents, pits, etc.) that protect and block excess of the coating material from building up on the charging pins.

Figure 1:
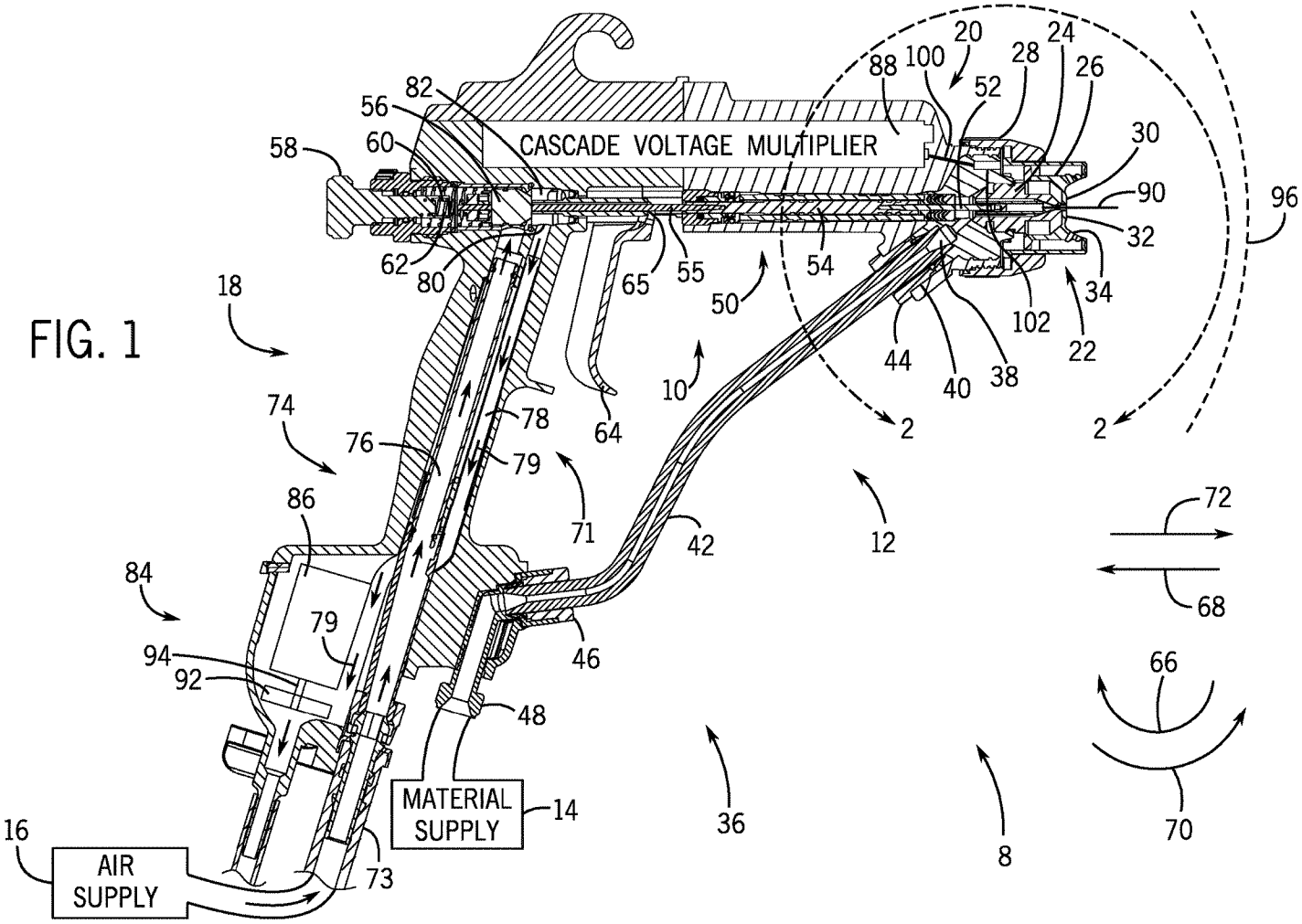
FIG. 1 is a cross-sectional side view of an embodiment of an electrostatic tool system with an electrostatic nozzle assembly.

FIG. 1 is a cross-sectional side view of an electrostatic tool system 8 with an electrostatic activation system 10. The electrostatic activation system 10 enables an operator to selectively apply electric charge to a material sprayed by an electrostatic tool 12. As illustrated, the electrostatic tool system 8 includes an electrostatic tool 12 configured to electrically charge and spray a material (e.g., paint, solvent, or various coating materials) towards an electrically attractive target. The electrostatic tool 12 receives sprayable material from a material supply 14 (e.g., liquid, powder, etc.), and the electrostatic tool 12 sprays the material with compressed air from an air supply 16 (or another gas supply). The air supply 16 may include a compressor, a compressed gas storage tank, or a combination thereof.

As illustrated, the electrostatic tool 12 includes a handle 18, a barrel 20, and a spray tip assembly 22. The spray tip assembly 22 includes a fluid nozzle 24, an air atomization cap 26, and retaining ring 28. As illustrated, the air atomization cap 26 covers the fluid nozzle 24, and is removably secured to the barrel 20 with the retaining ring 28. The air atomization cap 26 includes a variety of air atomization orifices, such as a central atomization orifice 30 disposed about a liquid tip exit 32 from the fluid nozzle 24. The air atomization cap 26 may also have one or more spray shaping air orifices, such as spray shaping orifices 34 that use air jets to force the spray to form a desired spray pattern (e.g., a flat spray). The spray tip assembly 22 may also include a variety of other atomization mechanisms to provide a desired spray pattern and droplet distribution.

The electrostatic tool 12 includes a variety of controls and supply mechanisms for the spray tip assembly 22. As illustrated, the electrostatic tool 12 includes a liquid delivery assembly 36 having a liquid passage 38 extending from a liquid inlet coupling 40 to the fluid nozzle 24. Included in the liquid delivery assembly 36 is a liquid tube 42. The liquid tube 42 includes a first tube connector 44 and a second tube connector 46. The first tube connector 44 couples the liquid tube 42 to the liquid inlet coupling 40. The second tube connector 46 couples the liquid tube to the handle 18. The handle 18 includes a material supply coupling 48, enabling the electrostatic tool 12 to receive material from the material supply 14. Accordingly, during operation, the material flows from the material supply 14 through the handle 18 and into the liquid tube 42, where the material is transported to the fluid nozzle 24 for spraying.

In order to control liquid and air flow, the electrostatic tool 12 includes a valve assembly 50. The valve assembly 50 simultaneously controls liquid and air flow as the valve assembly 50 opens and closes. The valve assembly 50 extends from the handle 18 to the barrel 20. The illustrated valve assembly 50 includes a fluid nozzle needle 52, a shaft 54, and an air valve needle 55, which couples to an air valve 56. The valve assembly 50 movably extends between the liquid nozzle 24 and a liquid adjuster 58. The liquid adjuster 58 is rotatably adjustable against a spring 60 disposed between the air valve 56 and an internal portion 62 of the liquid adjuster 58. The liquid adjuster 58, in some embodiments, may combine with other adjustment tools to adjust the amount of air passing through the shaft 54 and the air valve needle 55. The valve assembly 50 couples to a trigger 64 at point 65, such that the fluid nozzle needle 52 of the valve assembly 50 moves inwardly and away from the fluid nozzle 24 as the trigger 64 rotates in a clockwise direction 66. As the fluid nozzle needle 52 retracts, fluid begins flowing into the fluid nozzle 24. Likewise, when the trigger 64 rotates in a counter-clockwise direction 70, the fluid nozzle needle 52 moves in direction 72 sealing the fluid nozzle 24 and blocking further fluid flow.

An air supply assembly 71 is also disposed in the electrostatic tool 12, enabling atomization at the spray tip assembly 22, with compressed air from the air supply 16. The illustrated air supply assembly 71 extends from an air inlet 73 to the spray tip assembly 22 through an air passage 74 to the air atomization cap 26. The air passage 74 includes multiple air passages including a main air passage 76 and an electric generator air passage 78. As mentioned above, the valve assembly 50 controls fluid and air flow through the electrostatic tool 12 through movement of the trigger 64. As the trigger 64 rotates in a clockwise direction 66, the trigger 64 opens the air valve 56. More specifically, rotation of the trigger 64 in the clockwise direction 66 induces movement of the air valve 56 in direction 68 through movement of the air valve needle 55. As the air valve 56 moves in direction 68, the air valve 56 unseats from the sealing seat 80, enabling air to flow from the main air passage 76 into an air plenum 82. The air plenum 82 communicates with and facilitates airflow from the main air passage 76 into the electric generator air passage 78. In contrast, when the trigger 64 rotates in a counter-clockwise direction 70, the air valve 56 moves in direction 72 resealing with the sealing seat 80. Once the air valve 56 reseals with the sealing seat 80, air is unable to travel from the air supply 16 through the main air passage 76 and into the air plenum 82, for distribution into electric generator air passage 78. Accordingly, activation of the trigger 64 enables simultaneous liquid and airflow to the spray tip assembly 22. Indeed, once an operator pulls the trigger 64, the valve assembly 50 moves in direction 68. The movement of the valve assembly 50 in direction 68 induces the fluid nozzle needle 52 to retract from the fluid nozzle 24, enabling fluid to enter the fluid nozzle 24. Simultaneously, movement of the valve assembly 50 induces the air valve 56 to unseat from the sealing seat 80, enabling air flow through the main air passage 76 and into the air plenum 82. The air plenum 82 then distributes the air for use by the spray tip assembly 22 (i.e., to shape and atomize), and by the power assembly 84.

Figure 2:
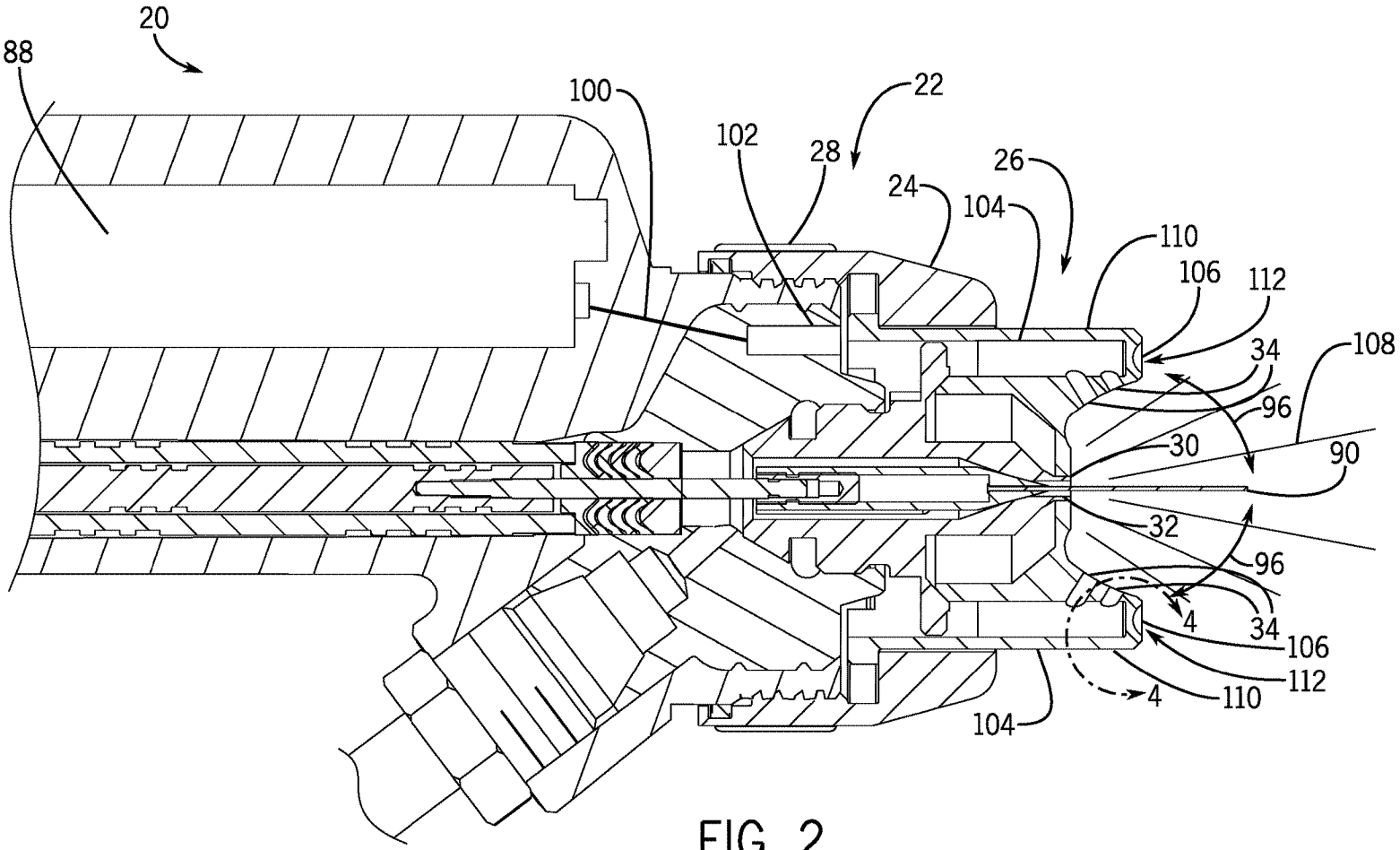
FIG. 2 is a cross-sectional detailed view of an embodiment of the spray tip assembly within line 2-2 of FIG. 1.

The power assembly 84 includes an electric generator 86, a cascade voltage multiplier 88 and conductive members, such as charging pins 106 (FIG. 2). As will be explained in detail below, the charging pins 106 are located within a recess to block the coating material from adhering to the charging pins 106 and to propagate an electric field. To produce the electric charge supplied to the charging pins 106, the air plenum 82 distributes an air flow into an electric generator air passage 78. The electrical generator air passage 78 directs airflow 79 from the air plenum 82 back through the handle 18 and into contact with a turbine 92 (e.g., a rotor having a plurality of blades). The airflow flows against and between the blades to drive rotation of the turbine 92 and a shaft 94, which in turn rotates the electric generator 86. The electrical generator 86 converts the mechanical energy from the rotating shaft 94 into electrical power for use by the cascade voltage multiplier 88. The cascade voltage multiplier 88 is an electrical circuit, which converts low voltage alternating current (AC) from the electrical generator 86 into high voltage direct current (DC). The cascade voltage multiplier 88 outputs the high voltage direct current to the charging pin or pins, which create an ionization field 96 between the charging pins 106 and a central conductive member (e.g., a grounded center pin 90) in the center of the fluid nozzle 24. It may be appreciated that the orientation of the charging pins 106 relative to the central conductive member (e.g., the grounded center pin 90) may contribute to the formation of the ionization field 96. In certain embodiments, the center pin 90 may be a conductive charging pin, while the pins 106 may be grounding pins. The ionization field 96 electrically charges atomized liquid sprayed by the electrostatic tool 12 as the fluid passes through the ionization field 96. In some embodiments, the cascade voltage multiplier 88 receives the power directly from a power grid, a separate generator such as a combustion engine driven generator, or other general purpose electrical voltage source.

FIG. 2 is a cross-sectional detailed view of an embodiment of the spray tip assembly 22 within line 2-2 of FIG. 1.

As illustrated, the electrostatic tool system 8 includes the cascade voltage multiplier 88 that converts and delivers a high voltage signal to the electrical components of the spray tip assembly 22. Specifically, the spray tip assembly 22 includes a wire 100 that connects the cascade voltage multiplier 88 to one or more conductive connectors 102 (e.g., 1, 2, 3, 4, 5, or more). The conductive connector 102 may be made of conductive plastic, metal, conductive polymer, or other material and conducts the voltage to one or more electrodes 104 and charging pins 106. The electrodes 104 are also conductive and may make contact with the conductive connector 102 and/or the charging pin 106 with epoxy or other securing agent. Accordingly, the voltage flows from the cascade voltage multiplier 88 to the wire 100, from the wire 100 to the conductive connector 102, from the conductive connector 102 to the electrode 104, then to the charging pin 106. These components (e.g., wire 100, conductive connector 102, electrode 104 and charging pin 106) may be secured chemically by using an adhesive or bonding material, or mechanically through threads, interference fit, snap-fit, coupling, latches, clamps, screws, etc. For example, the charging pins 106 and the electrodes 104 may be secured with a bonding material (e.g., epoxy, glue, plastic, composite material, etc.) within the air atomization cap 26 while the conductive connector 102 may be secured by the retaining ring 28 into a secured position. Mechanically securing the conductive connector 102 may facilitate replacement of the conductive connector 102.

As stated above, the charging pins 106 and the grounded center pin 90 interact to produce the ionization field 96 to charge the particulated coating material 108 as it exits the central atomization orifice 30. In some embodiments, the charging pins 106 may be located on air horns 110 that include the spray shaping orifices 34. The relative position of the charging pins 106 and the grounded center pin 90 may be adjusted to control (e.g., vary, increase, or decrease) the ionization field 96 while maintaining protection of the charging pins 106 from stray particles of coating material 108. For example, the charging pins 106 may be located within recesses 112 (e.g., divots, grooves, dents, pits, etc.) in the surface of the air horn 110. In some embodiments, the air atomization cap 26 may include charging pins 106 that are angled and/or located closer or further from the grounded center pin 90 so that the ionization field 96 is at a suitable strength to charge the coating material 108.

Figure 3:
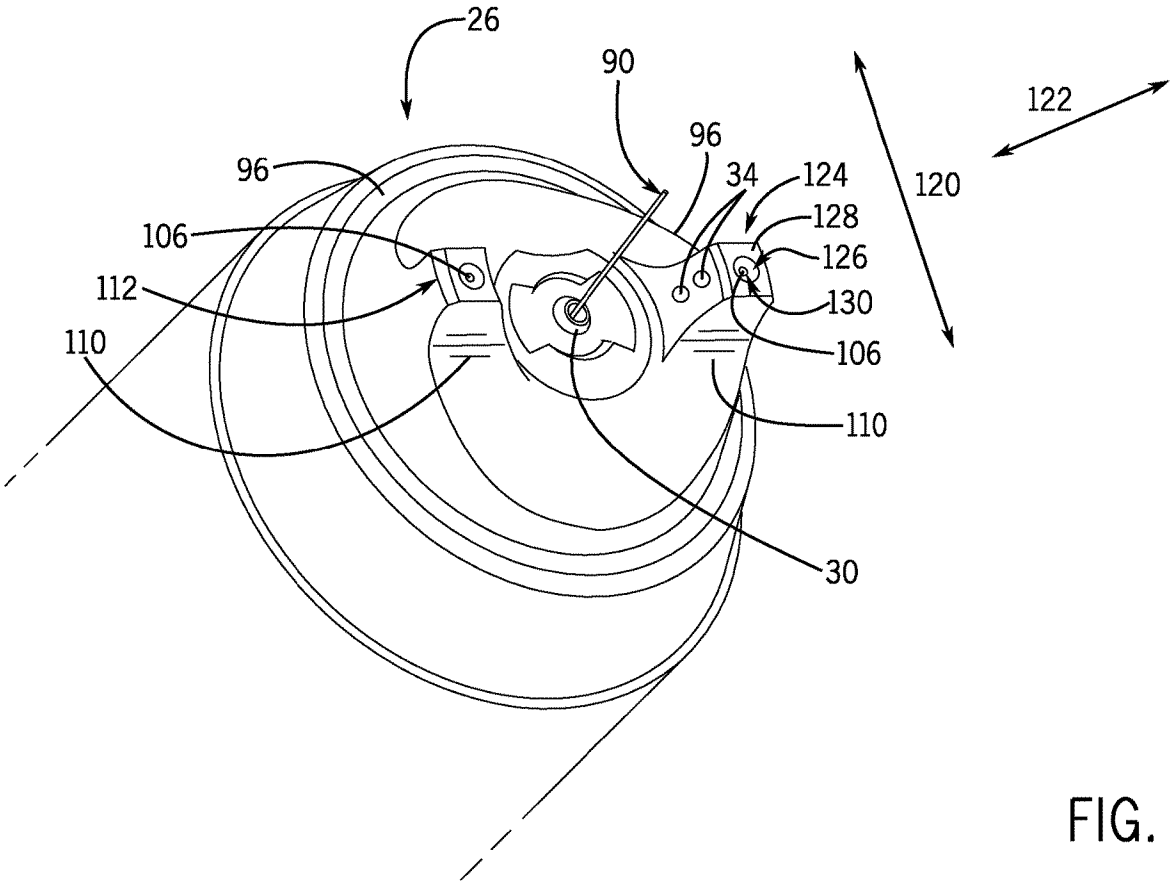
FIG. 3 is a perspective view of an embodiment of the air atomization cap of FIGS. 1 and 2.

FIG. 3 is a perspective view of an embodiment of the air atomization cap 26 of FIGS. 1 and 2. The illustrated embodiment includes the air horns 110 to the side of the grounded center pin 90. The air horns 110 direct the coating material 108 into a fan-shaped pattern along a vertical axis 120 due to the flow from the air shaping orifices 34. As illustrated, each charging pin 106 rests within the recess 126 of a distal surface 128 of a distal end 124 of each respective air horn 110. The recess 126 may be a few millimeters deep below the distal surface 128, or may be a centimeter or more below the distal surface 128 of the air horn 110 (e.g., 1 to 40, 1 to 20, 1 to 10, or 10 to 5 mm deep). For example, the recess 126 may be greater than 1, 2, 3, 4, 5, or 10 mm deep. The charging pin 106 protrudes from the bottom of the recess 126 to a distance 130 that may be less than, equal to, or greater than a depth of the recess 126. Thus, the pin 106 may be recessed below, flush with, or protrude beyond the distal surface 128. In some embodiments, the charging pin 106 may have a distance 130 that is just even with the distal surface 128 of the air horn 110. In other embodiments, the charging pin 106 may have a distance 130 extending to just a few tenths of a millimeter above or below the distal surface 128. In still other embodiments, the charging pin 106 may extend a distance 130 that is 1, 2, 3, 4, 5, 6, 7, 8, 9, 10, or more millimeters above or below the distal surface 128.

The distance 130, and other positioning aspects, of the charging pin 106 may be calibrated to block the amount of stray coating material 108 that is fixed to the charging pin 106 while balancing the interference of the air horn 110 with the ionization field 96. Specifically, the charging pin 106 may accumulate more stray coating material 108 if the distance 130 is greater. Conversely, when the distance 130 is relatively smaller (i.e., the charging pin 106 is deeper within the recess 126), then the edges of the recess 126 may gradually reduce the effectiveness or intensity of the ionization field 96. Additionally, a smaller distance 130 may also contribute to etching of the air horn 110. That is, the ionization field 96 may travel through the material of the air horn 110 which can cause deterioration (e.g., removal of substance) of the air horn 110.

Figure 4:
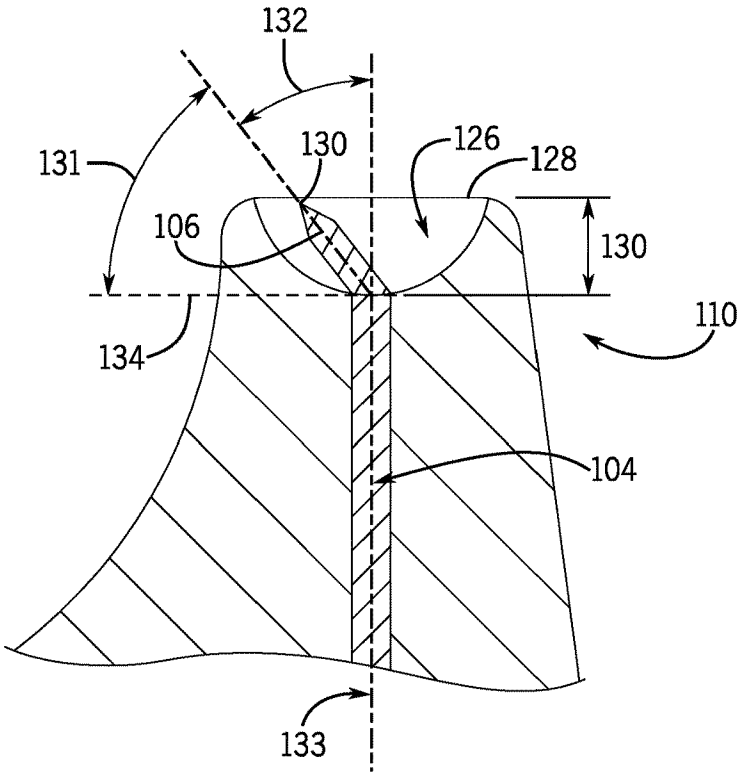
FIG. 4 is a partial cross-sectional detailed view of an embodiment of an air horn within line 4-4 of FIG. 2.

FIG. 4 is a partial cross-sectional detailed view of an embodiment of the air horn 110 within line 4-4 of FIG. 2. For simplicity, FIG. 4 does not include air shaping orifices 34, but these and other components may be included as part of the air horn 110 and/or the spray tip assembly 22. FIG. 4 illustrates the electrode 104 that extends through an aperture in the air horn 110 and is connected to the charging pin 106 as stated above. FIG. 4 also illustrates clearly the position of the charging pin 106 with respect to the distal surface 128. The distance 130 is measured from the bottom of the recess 126. As explained above, the charging pin 106 may extend various distances 130, so that the charging pin 106 is below, above, or even with the distal surface 128. FIG. 4 also illustrates that the charging pin 106 may be arranged at an angle 131 relative to a radial line or direction 134 of the spray tip assembly 22, or at an angle 132 relative to an axial line or axis (e.g., axis 133) of the spray tip assembly 22. For example, in some embodiments the recess 126 may be laterally large enough so that the angle 132 of the charging pin 106 may be approximately 0, 30, 45, 60, 90, 120, 135, 180 degrees, between 5 to 80 degrees, 30 to 60 degrees, 35 to 45 degrees, or any other angle there between with respect to an axial axis 133 of the electrode 104 (or an axial axis of the center pin 90, air atomization cap 26, and spray tip assembly 22). In certain embodiments, the angle 131, 132 of the charging pins 106 may be fixed as part of the air atomization cap 26. In other embodiments, the charging pins 106 may be modular removable pins 106 selectable with different angles 131, 132. Thus, one air atomization cap 26 may employ different charging pins 106 with different angles 131, 132, and/or shapes.

In certain embodiments, the charging pin 106 may also have various shapes. As illustrated in FIG. 4, the charging pin 106 may include a pointed shape or needle tip shape. The pointed shape may enable a specific targeted area to receive the ionization field 96. In other embodiments, charging pin 106 may spread or reduce the ionization field using a differently shaped charging pin 106. For instance, as illustrated on the left side of FIG. 5, the charging pin 106 may include a rounded or bulbed shape which may reduce intensity of the ionization field 96 in a specific area. Also illustrated in FIG. 5, on the right side, the charging pin 106 may include a fan shape that delivers the ionization field 96 over a broader area, which may increase uniformity of the ionization field 96 over a given area.

Figure 5:
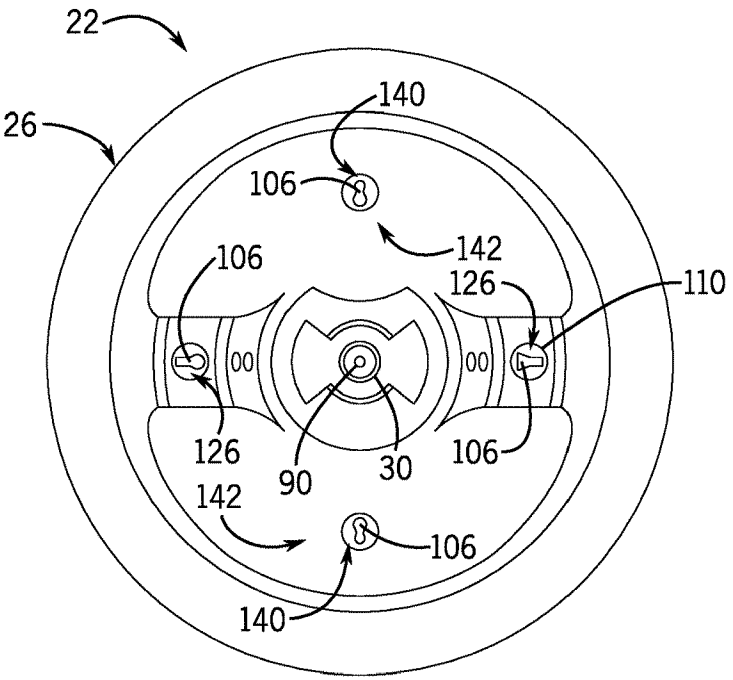
FIG. 5 is a front view of an embodiment of the spray tip assembly of FIG. 3.

FIG. 5 is a front view of an embodiment of the spray tip assembly 22 of FIG. 3. The illustrated embodiment includes the air horns 110 with recesses 126 and charging pins 106. In some embodiments, the air atomization cap 26 may include two side recesses 140 with charging pins 106 that are not within an air horn 110. The recesses 140 depress into the side surface 142 so that the charging pin 106 may rest within the recess 140. Like the charging pins 106 in the recess 126, the charging pins 106 within the recess 140 may be above, below, or even with the surface 142. In some embodiments, the side surface 142 may be inclined relative to the grounded center pin 90. An example of an inclined side surface 142 may be seen in FIG. 3. The side surface 142, in certain embodiments, may also be flat, i.e., perpendicular to the grounded center pin 90.

In certain embodiments, the air atomization cap 26 may include additional recesses 126, 140 (e.g., 1, 2, 3, 4, 5, 6, 7, 8, 9, 10, or more) with respective charging pins 106 that produce the ionization field 96. The additional recesses 126, 140 may be located on additional air horns 110 and in the surface 142. In some embodiments, the air atomization cap 26 may include no air horns 110. In the case of no air horns 110, each of the recesses 126, 140 may be depressed into the side surface 142, rather than the distal surface 126.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

an electrostatic spray system, comprising:

an electrostatic tool; and a spray tip assembly configured to receive a coating material and an airflow to atomize and charge the coating material, and spray the coating material in an airflow direction, comprising:

a first air cap horn comprising a first recess on a first exterior surface at a first distal end of the first air cap horn, wherein the first recess surrounds an outlet of an aperture that extends through the first air cap horn;

a first charging pin configured to extend through the aperture and disposed within the first recess; and a grounded pin, wherein the first charging pin and the grounded pin are configured to produce an electric field that charges the coating material.

2. The system of claim 1, wherein the spray tip assembly comprises a second air cap horn, and the first and second air cap horns each comprise a spray shaping orifice.

3. The system of claim 2, wherein the second air cap horn comprises a second recess on a second exterior surface at a second distal end of the second air cap horn and a second charging pin within the second recess.

4. The system of claim 3, comprising a third recess disposed on an exterior side surface of the spray tip assembly between the first air cap horn and the second air cap horn, wherein the third recess comprises a third charging pin.

5. The system of claim 1, wherein a tip of the first charging pin is positioned between 1 mm above the first distal end and 5 mm below the first distal end.

6. The system of claim 1, comprising a cascade voltage multiplier configured to provide a voltage to the first charging pin.

7. The system of claim 6, wherein the spray tip assembly comprises a wire electrically coupled to the cascade voltage multiplier, an electrode electrically coupled to the first charging pin, and a conductive pin removably coupled between the wire and the electrode.

8. The system of claim 7, wherein the conductive pin comprises a conductive plastic.

9. A system, comprising:

an air atomization cap configured to couple to a body of an electrostatic tool system, comprising:

an atomization orifice configured to atomize a liquid material;

a distal exterior surface around the atomization orifice;

a first recess disposed on the distal exterior surface, wherein the first recess surrounds an outlet of an aperture in the air atomization cap;

a first pin configured to extend through the aperture and disposed within the first recess; and a center pin disposed within the atomization orifice, wherein the first pin and the center pin are configured to propagate an electric field.

10. The system of claim 9, wherein the first pin comprises a pointed shape, a bulbed shape, a fan shape, or any combination thereof.

11. The system of claim 9, wherein the air atomization cap comprises a second recess disposed on the distal exterior surface, and a second pin disposed within the second recess, and the first recess and the second recess are on opposite sides of the center pin.

12. The system of claim 11, wherein the center pin is electrically charged and the first pin and the second pin are grounded.

13. The system of claim 9, wherein a tip of the first pin is positioned between 1 mm above the distal exterior surface and 5 mm below the distal exterior surface.

14. The system of claim 9, wherein the first pin is angled between 10 and 90 degrees relative to an axis of the air atomization cap.

15. The system of claim 9, wherein the center pin comprises a wire protruding from the air atomization cap.

16. The system of claim 9, wherein the center pin comprises a tip that is flush with the distal exterior surface.

17. A system, comprising:

an electrostatic spray device, comprising:

a first outlet configured to output a spray material into a region downstream from the first outlet;

a first conductive member disposed in a first recess of an exterior surface of the electrostatic spray device, wherein the first recess surrounds an outlet of an aperture and the first conductive member is configured to extend through the aperture and beyond the exterior surface; and a second conductive member offset from the first conductive member, wherein the first and second conductive members are configured to help generate an electric field in the region downstream from the first outlet.

18. The system of claim 17, wherein the first conductive member comprises a first charging member.

19. The system of claim 18, wherein the second conductive member comprises a second charging member disposed in a second recess of the exterior surface of the electrostatic spray device.

20. The system of claim 18, wherein the second conductive member comprises a grounding member.

21. The system of claim 17, wherein the first recess and the first conductive member are offset away from the first outlet.

22. The system of claim 17, wherein the first recess and the first conductive member are disposed in a first horn of the electrostatic spray device.

23. The system of claim 17, wherein the first recess curves inwardly.

24. The system of claim 17, wherein the electrostatic spray device comprises a spray head having the first outlet, the first conductive member, and the second conductive member.

* * * * *